US007218286B2

(12) United States Patent
Munk

(10) Patent No.: US 7,218,286 B2
(45) Date of Patent: May 15, 2007

(54) HOLLOW WAVEGUIDE SECTOR ANTENNA

(75) Inventor: Marco Munk, Aichwald (DE)

(73) Assignee: Marconi Communications GmbH

( * ) Notice: Subject to any disclaimer, the term of this patent is extended or adjusted under 35 U.S.C. 154(b) by 0 days.

(21) Appl. No.: 10/514,704

(22) PCT Filed: May 13, 2003

(86) PCT No.: PCT/IB03/02414

§ 371 (c)(1),
(2), (4) Date: Jul. 18, 2005

(87) PCT Pub. No.: WO03/098742

PCT Pub. Date: Nov. 27, 2003

(65) Prior Publication Data

US 2006/0164315 A1 Jul. 27, 2006

(30) Foreign Application Priority Data

May 21, 2002 (DE) ..... 102 22 838

(51) Int. Cl.
*H01Q 13/10* (2006.01)

(52) U.S. Cl. ..... 343/771

(58) Field of Classification Search ..... 343/770, 343/771
See application file for complete search history.

(56) References Cited

U.S. PATENT DOCUMENTS 6,285,335 B1 * 9/2001 Snygg et al. ..... 343/770

* cited by examiner

*Primary Examiner*—Michael C. Wimer
(74) *Attorney, Agent, or Firm*—Kirschstein, et al.

(57) ABSTRACT

A hollow waveguide group antenna comprises a hollow waveguide extending in a direction in space and a plurality of chambers, each of which has a sending/receiving slit and is coupled to the hollow waveguide by a coupling slit. The sending/receiving slits are distributed at a fixed distance from each other, and the distribution of the coupling slits in the direction in space at the transversal hollow waveguide is selected differently from the distribution of the sending/receiving slits such that a wave propagating at the working frequency excites the sending/receiving slits with amplitudes and phases suitable for realizing a sector direction characteristic. The fixed distance is approximately $0.5\lambda_0$ for 90° sector direction characteristic and approximately $0.64\,\lambda_0$ for a 45° sector direction characteristic.

23 Claims, 7 Drawing Sheets

HOLLOW WAVEGUIDE SECTOR ANTENNA

The present invention relates to a sector antenna.

Performance requirements for sector antennas for wireless transmission are very high. These are uniform coverage of a certain range, e.g. a 90° sector, in the horizontal plane with a strong intensity decrease of sidelobes, and a highly directive, zero-free characteristic for the vertical plane. From H. Ansorgen, M. Guttenberger, K.-H. Mierzwiak, U. Oehler, H. Tell, "Antenna solutions for point to multi-point radio systems" ECRR, Bologna 1996 and M. Guttenberger, H. Tell, U. Oehler, "Microstrip-Gruppenantennen mit scharf sektorisierenden Eigenschaften als Zentralstationsantennen für Punkt zu Multipunkt Systeme", ITG Fachtagung Antennen, Müinchen, 1998, it is known to realize such sector antennas in strip-line technique.

A general problem of such conventional sector antennas is an insufficient suppression of cross polarization.

In order to realize a desired directional characteristic of such a group antenna, its individual radiating elements must be excited with different excitation coefficients. These excitation coefficients are complex, i.e. they are characterized by magnitude and phase. Methods for calculating them are known. The excitation is achieved using a distributing network that distributes a transmission signal fed into its input to the individual radiating elements. The assigned excitation coefficients are defined by the structure of the distributing network.

Distributing networks in strip-line technique are disadvantageous due to their losses. These losses increase strongly with increasing operating frequencies of the distributing network, so that in particular at high operating frequencies, there is a need for group antennas with reduced loss. Such group antennas may be realized in hollow waveguide technique.

A problem with the design of hollow waveguide group antennas is that for realizing a desired sector characteristic, specific small distances are necessary between adjacent radiating elements, which radiate at essentially opposite phases. E.g. for a 90° sector characteristic, this distance is approximately 0.5 $\lambda_0$, wherein $\lambda_0$ is the free space wavelength of a wave emitted by the antenna. The length $\lambda_H$ of a wave of given frequency in a hollow waveguide of finite cross section is always greater than its wavelength $\lambda_0$ in free space; it converges towards the free space value if the width of the hollow waveguide approaches infinity. With a group antenna whose radiating elements are apertures in a hollow waveguide wall, a satisfying sector characteristic might theoretically be achieved if an extremely wide hollow waveguide is used. However, this is not a technically practical solution.

A group antenna according to the preamble portion of claim 1 is known from U.S. Pat. No. 6,127,985.

This prior art group antenna is formed of a plurality of layers. A first such layer comprises a two-dimensional arrangement of chambers, each of which has a sending/receiving slit and a coupling slit, respectively, at opposite sides thereof. The coupling slits of several chambers jointly lead into a transversal hollow waveguide extending in a second layer. The distance of the coupling slits along the transversal hollow waveguide is selected so that all coupling slots are excited at equal phase, i.e. the distance of the coupling slits corresponds to the wavelength in the transversal hollow waveguide at a resonance frequency of the antenna. Since the chambers of this prior art antenna have the same geometry, the sending/receiving slits of all chambers radiate at equal phases. Thus, with a large number of slits, a strong collimation of the main lobe of the radiation diagram can be realized. There is no filling up of zeros of the direction characteristic. A sector characteristic cannot be realized with this prior art antenna.

The object of the present invention is to provide a compact group antenna with sector characteristic having low losses even at high frequencies.

The object is achieved by a group antenna having the features of claim 1.

Besides low loss, this group antenna has the additional advantage of a reduced cross polarization in comparison to stripline antennas.

The proposed solution relies on the conception that by sandwiching chambers between sending/receiving slits of a group antenna and a hollow waveguide, here referred to as transversal hollow waveguide, which jointly supplies the sending/receiving slits, it is possible to excite the sending/receiving slits with appropriate phases and amplitudes for a sector characteristic by selecting the arrangement of the coupling slits at the transversal hollow waveguide—at variance from the arrangement of the sending/receiving slits at an outer side of the antenna—such that the coupling slits come to lie at places of the transversal waveguide at which fields with appropriate amplitude and phase relationships may be coupled out.

The transversal hollow waveguide has a short-circuit at at least one end thereof, so as to reflect waves propagating in the transversal hollow waveguide. The distance of this short-circuit from the closest adjacent coupling slit preferably amounts to approximately half of the hollow waveguide wavelength of a wave propagating in the transversal hollow waveguide at the operating frequency. Thus, a highest possible intensity of this wave at the location of this coupling slit is achieved.

The sending/receiving slits are preferably oriented transversally to the first spatial direction, i.e. the longitudinal direction of the transversal hollow waveguide. Thus it is possible give the slits a length of approximately $\lambda_0/2$, so that they are resonant at the working frequency of the antenna or close to this frequency.

Simulation analyses have shown that a distance that is slightly larger than half of the free space wavelength, particularly in the range between 0.51 and 0.55× the free space wavelength, is advantageous for realizing a 90° sector characteristic.

For a 45° sector characteristic, a distance between 0.58 and 0.63×, preferably of approximately 0.62× the free space wavelength, is appropriate.

According to a preferred embodiment, the arrangement of the coupling slits is mirror symmetric with respect to a symmetry plane oriented transversally to the first spatial direction, and the transversal hollow waveguide has an excitation aperture intersecting the symmetry plane. A centered excitation of the transversal hollow waveguide by such an aperture has the advantage, with respect to excitation at an end of the hollow waveguide, that the maximum difference between the phase values with which a wave propagating in the transversal hollow waveguide appears at the coupling slits is only half as large under centered excitation than under end excitation, so that a larger bandwidth of the antenna can be achieved.

Of course, in case of centered excitation, it is appropriate to terminate both ends of the transversal hollow waveguide by a short circuit. The number of coupling slits of the transversal hollow waveguide is preferably between 4 and 6. It is assumed that with larger numbers of coupling slits and chambers connected thereto, group antennas with an excellent sector characteristic may be realized, but it has been found that with four coupling slits, very good results can already be achieved, so that more effort is not necessary.

Due to the centered excitation of the transversal hollow waveguide, the phase of chambers adjacent to the symmetry plane is always the same, regardless of the distance of the coupling slits of these chambers from the symmetry plane. Therefore, this distance may be varied in order to influence the resonance frequency of the transversal hollow waveguide or to optimize the amplitude/phase relationship between the sending slits adjacent to the symmetry plane and the remaining sending slits. A distance between the symmetry plane and the adjacent coupling slits of approximately one fourth of the hollow waveguide wavelength has been found to be appropriate.

For adapting amplitudes and phases, it is also possible to adapt the distance between a coupling slit adjacent to the symmetry plane and a coupling slit adjacent to the short-circuit. Here, a value of approximately 0.3 hollow waveguide wavelengths has been found to be appropriate.

With the group antenna described above, a sector characteristic in a first plane, in a practical application preferably the horizontal plane, may be realized. In order to achieve a collimation in a plane perpendicular thereto, i.e. preferably in the vertical plane, it is preferred to employ an arrangement of several such group antennas, in which the transversal hollow waveguides of the group antennas are parallel and which may be referred to as a "two-dimensional group antenna".

In order to jointly feed the group antennas of the two-dimensional group antenna, it is preferred that each transversal hollow waveguide has an excitation aperture leading to a hollow waveguide, which is common to several transversal waveguides.

In order to achieve a collimation in the second plane, it is desirable that adjacent transversal hollow waveguides are excited at approximately equal phases by a wave propagating in the common waveguide at the working frequency, in order to obtain approximately equal phases between the sending/receiving slits corresponding to these transversal hollow waveguides, too. Deviations from the exact identity of the phases are desirable in order to prevent a decrease to zero between adjacent maximums of the direction characteristic.

According to a first embodiment, the common hollow waveguide may be a longitudinal hollow waveguide extending straightly in a second direction in space.

If this longitudinal hollow waveguide is a rectangular hollow waveguide, the width a of its sidewall in which the excitation apertures are formed is preferably given by $$a = \frac{\lambda_0}{2\sqrt{1 - \frac{\lambda_0^2}{4d^2}}},$$

wherein $\lambda_0$ is the free space wavelength of a working frequency of the group antenna and d is the distance between adjacent excitation apertures of the longitudinal hollow waveguide. In this way, a phase difference of $\pi$ between two adjacent excitation apertures can be realized for the wave propagating inside the longitudinal hollow waveguide at the working frequency.

In order to be able to couple waves at equal phases—except for correction terms—into the transversal hollow waveguides at all excitation apertures, it is desirable that mutually adjacent excitation apertures have coupling coefficients with opposite signs. For this purpose, mutually adjacent excitation apertures are located at alternating sides of the center plane of the longitudinal hollow waveguide. A fine tuning of the phase of the coupled transversal waveguide waves is possible by an appropriate choice of a rotation angle of each excitation aperture with respect to the center plane. Such a rotation also has an influence on the amplitude of the coupled transversal waveguide wave, but this influence can be compensated by an appropriate choice of the lateral deviation of the excitation aperture from the center plane.

In order to avoid perturbations of the coupling by reflections at an end of the longitudinal hollow waveguide, it is preferred to locate a short-circuited end of the hollow waveguide in a distance d/2 from the excitation aperture adjacent to it.

According to a second embodiment of the invention, the first hollow waveguide is formed as a tree structure having a trunk and a plurality of branches, each of which connects the trunk to one of the excitation apertures. The individual branches may easily be assigned different lengths and, hence, phase corrections. Further, bifurcations may be formed asymmetrically, in order to achieve a desired non-uniform power distribution to the individual branches as required in order to obtain amplitude and phase conditions at the radiating elements as required for a zero-free collimation in the second plane. This embodiment has the advantage that the length of the branches must not differ from each other by more than $\lambda_H$, wherein $\lambda_H$ is the wavelength at the working frequency of the group antenna inside the tree structure. I.e. if a wave propagating within the tree structure deviates from this working frequency, the deviations cannot produce accumulating phase errors that occur in case of the longitudinal hollow waveguide, so that, compared to this solution, a much larger bandwidth of the group antenna can be achieved.

The tree structure preferably has two main branches issuing from a common trunk and extending at opposite sides of a plane extending through the excitation apertures, wherein the excitation apertures of mutually adjacent transversal hollow waveguides are each connected to different one of these main branches. This structure makes it very easy to tune deviations of the individual transversal hollow waveguides from a common phase that are necessary in order to avoid zeros of the direction characteristic in the second plane, by choosing the hollow waveguide length between the trunk and each individual excitation aperture.

In order to optimize the direction characteristic in the second plane, it is desirable to be able to excite the various transversal hollow waveguides at different amplitudes. For this purpose, the branches of the tree structure leading to the excitation apertures preferably have different power levels.

The different power levels are preferably realized at bifurcations, e.g. T- or Y-sections of the tree structure by conferring different cross sections on portions of such a bifurcation that lead to different apertures. Specifically, these different cross sections may be obtained by a tongue extending asymmetrically into the bifurcation.

Further features and advantages of the invention become apparent from the subsequent description of embodiments referring to the appended Figures.

Figure 1:
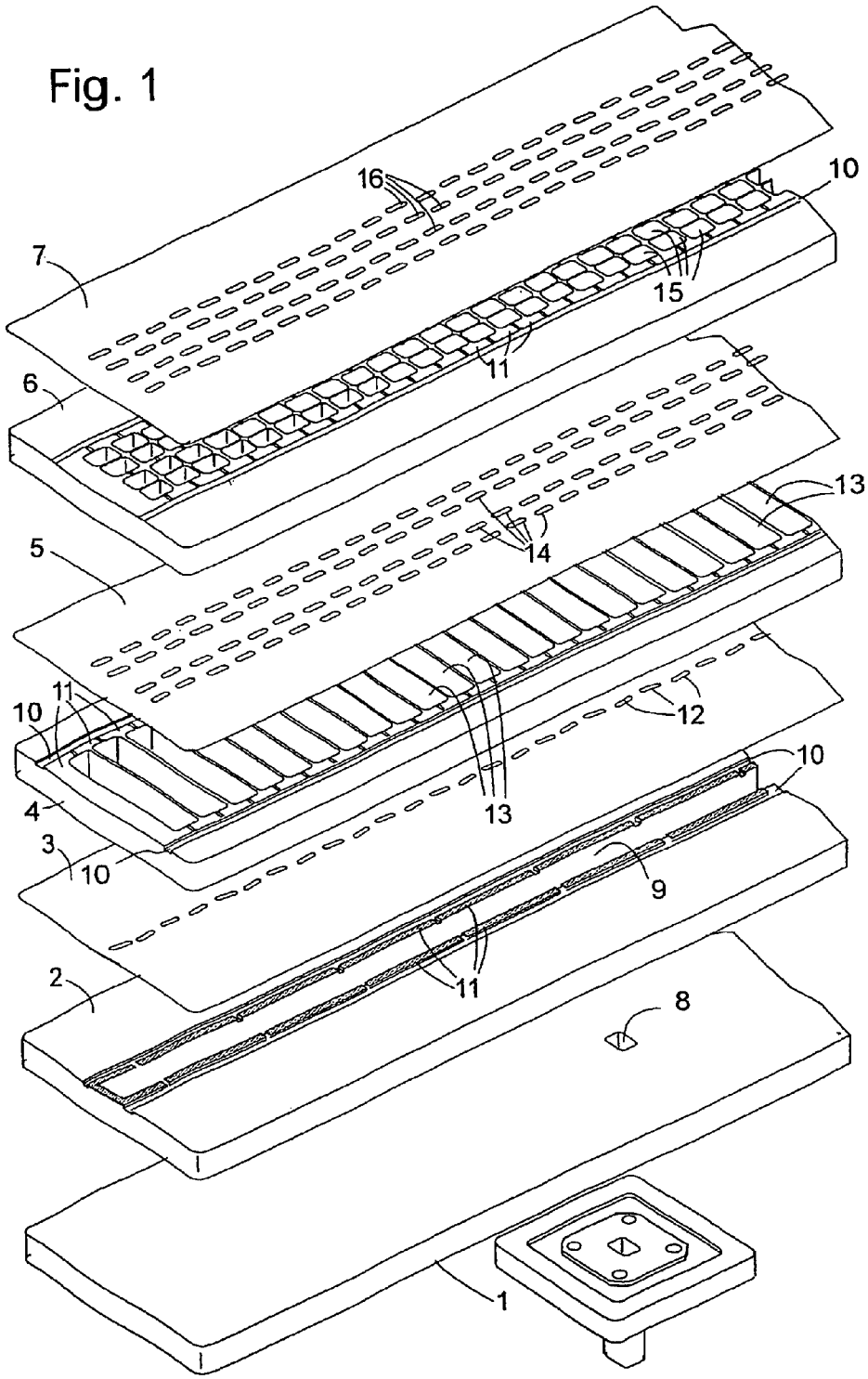
FIG. 1 illustrates a first embodiment of a sector antenna according to the invention in an exploded view.

A first embodiment of the sector antenna of the invention is explained referring to FIG. 1. This Figure shows a plurality of metal plates 1 to 7 from which the antenna is formed layer by layer. A plate 1 shown in a bottom position in the Figure has a bore 8 and is provided for connecting a coupling flange of a tubular hollow waveguide for feeding an RF signal to be transmitted by the antenna or for extracting an RF signal received by it to the bottom side of the plate 1 at the bore 8. In the description, only the aspect of transmitting using the antenna according to the invention will be considered; it is understood, however, that the antenna can be used without modification for receiving an RF signal.

In a plate 2 arranged above plate 1, a first hollow waveguide, referred to as longitudinal hollow waveguide, extends in a longitudinal direction. Via the opening 8, the first hollow waveguide is fed an RF signal, which propagates inside the first longitudinal hollow waveguide 9 from the bore 8 in opposite directions.

The first hollow waveguide 9 is formed as a slit extending over the complete height of plate 2.

At either side of the first hollow waveguide 9, flat grooves 10 extend in the longitudinal direction on top and bottom sides of plate 2. Together with the hollow waveguide 9, they delimit narrow surface portions 11 that are flush with the remainder of the top and bottom sides and are highlighted in the Figure by hatching and which carry solder for soldering the plate 2 to the adjacent plates 1 and 3, respectively.

Plate 3 is a thin metal sheet which, when connected to plate 2, forms a broad sidewall of the rectangular longitudinal hollow waveguide 9. A plurality of slit shaped excitation apertures 12 is formed in various orientations with respect to the longitudinal direction of the longitudinal hollow waveguide 9 and with various deviations with respect to the center plane of the longitudinal hollow waveguide 9.

In plate 4, a plurality of second hollow waveguides 12, referred to as transversal hollow waveguides, extends in a transversal direction of the plate, at right angles with the longitudinal hollow waveguide 9. All transversal hollow waveguides have a same length. An excitation aperture 12 leads to each of these. Each transversal hollow waveguide 13 is positioned such that the excitation aperture 12 leading to it is exactly in the center of the transversal hollow waveguide 13. Therefore, the positions of the transversal hollow waveguides 13 in the transversal direction vary slightly, according to the various deviations of the excitation apertures 12 leading to them.

Also in plate 4, portions 11 of upper and lower sides, which are intended to be coated with solder are separated from the remainder of the upper and lower sides by longitudinal grooves 10.

In a thin plate 5 to be soldered to plate 4, a plurality of coupling slits 14 is formed. The coupling slits 14 are oriented transversally with respect to the transversal hollow waveguides 13 and are arranged in a matrix of lines and rows parallel to the transversal hollow waveguides 13, one column of four coupling slits 14 being located above each of the transversal hollow waveguides. Within a line, the positions of the individual slits vary slightly in the transversal direction of plate 5, in correspondence with the varying positions in this direction of the transversal hollow waveguides 13 themselves and the excitation apertures 12, respectively.

A thick plate 6 to be placed on plate 5 has a plurality of through bores of approximately rectangular cross section, each of which forms a chamber 15 together with the plate 5 and a plate 7 forming the outer side of the antenna. One coupling slit 14 of plate 5 and one sending slit 16 of plate 7 leads to each of the chambers 15. The sending slits 16 belonging to chambers 15 fed by a same hollow waveguide 13 are arranged at equal distances in a line. The individual lines are slightly displaced with respect to each other in the transversal direction of plate 7.

In this embodiment, the thick plates 1, 2, 4, 6 may be formed by machining from bulk material, whereas the thin plates 3, 5, 7 may be punched from thin metal sheets, and the plates are connected to each other by soldering.

Figure 2:
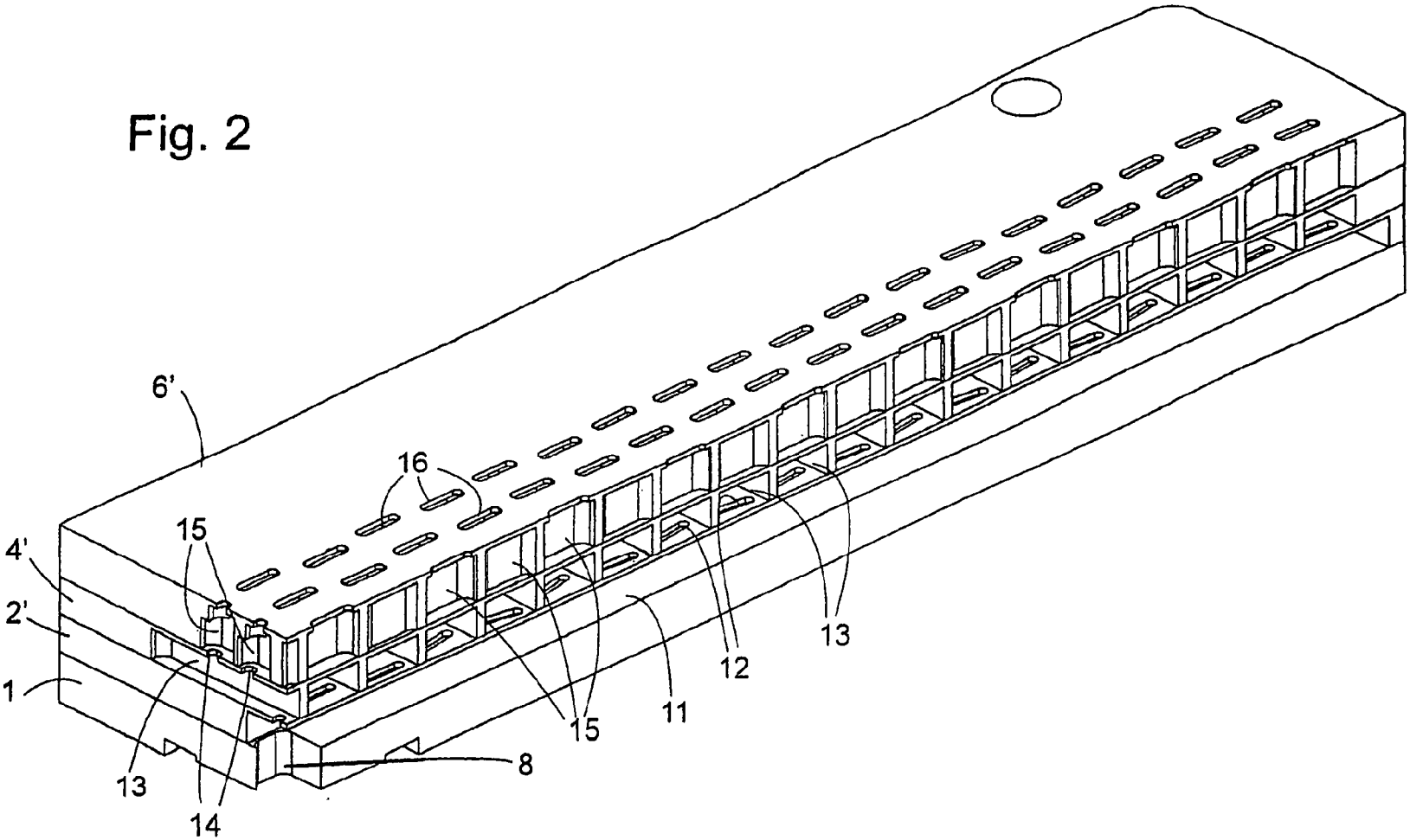
FIG. 2 is a perspective view of a second embodiment of the sector antenna, in an assembled state.

In the embodiment shown in FIG. 2, the geometry of the hollow waveguides and slits is not different from that of FIG. 1. It is formed of four plates 1, 2', 4', 6', wherein plate 1 corresponds to plate 1 of FIG. 1 and plates 2', 4', 6' may be regarded as one-part combinations of plates 2 and 3, 4 and 5, 6 and 7, respectively, of FIG. 1.

Elements that are identical in the two embodiments have the same reference numerals in FIG. 2 as in FIG. 1 and are not described anew. FIG. 2 is a perspective view of the antenna, cut open along the longitudinal hollow waveguide 11.

In order to be useable as a sector antenna for microwave applications, the direction characteristic of the antenna must meet the following requirements: In a first plane defined by the surface normal of plate 7 and the transversal direction, referred to in the following as the horizontal plane, the direction characteristic must have a main lobe which is practically constant over an angular range of approximately 90°, and no side lobes. In a plane referred to as the vertical plane, defined by the surface normal of plate 7 and the longitudinal direction, the direction characteristic must be sharply collimated and zero-free in a region close to the main lobe.

Considering the requirements for the direction characteristic in the horizontal plane, it is sufficient to consider a single transversal hollow waveguide 13 and the chambers fed by it. The requirement of a 90° sector direction characteristic implies a distance of $\lambda_0/2$ between adjacent sending slits, wherein $\lambda_0$ is the free space wavelength of a signal to be radiated by the antenna. The relative amplitudes and phases of the four sending slits 16 can be determined by a simulation calculation. Since software for carrying out such calculations is known, no description thereof is necessary; in case of a 90° sector direction characteristic. The results obtained for the individual sending slits, one after the other, are:

(−5.7 dB; 122°); (0; 0); (0; 0); (−5.7 dB; 122°), if the distance between the sending slits 16 is exactly 0.5 $\lambda_0$, or (−6.0 dB; 125°); (0; 0); (0; 0); (−6.0 dB; 125°), for a distance of the sending slits of 0.52 $\lambda_0$.

In order to realize these amplitudes and phases, it is sufficient to place the coupling slits between the chambers 15 and the transversal hollow waveguide 13 appropriately and to choose the length of the transversal hollow waveguide 13 suitably, as explained in more detail in the following.

Figure 3:
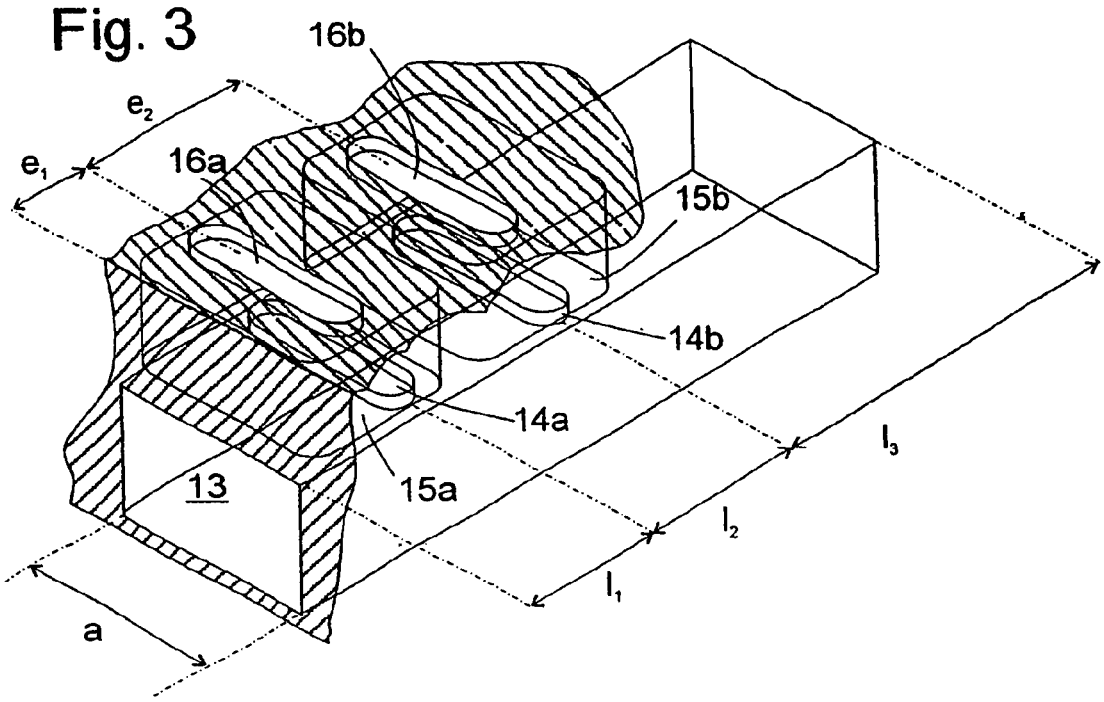
FIG. 3 is a schematic view of half of a transversal hollow waveguide and chambers located thereat.

FIG. 3 is a schematic view of a half of a transversal hollow waveguide 13, bisected along its symmetry plane, and the chambers 15 located near it, referred to as 15*a*, 15*b* in this Figure. As can be seen in the drawing, there are three parameters which may be optimized for realizing the desired phases and amplitudes: the distance $l_1$ between the symmetry plane and the coupling slit adjacent to it, here referred to by reference numeral 14*a*, the distance $l_2$ between the coupling slit 14*a* and the coupling slit 14*b* adjacent to the short-circuited end of the hollow waveguide, and the distance $l_3$ between coupling slit 14*b* and the end of the transversal hollow waveguide 13. These three parameters have been shown to be sufficient for realizing a 90° direction characteristic; in case of need, one might consider optimizing further parameters such as length and width of the coupling slits.

In order to find a distribution of the coupling slits 14*a*, 14*b* which is suitable for realizing the desired sector direction characteristic, one may start from a combination of the parameters $l_1$, $l_2$, $l_3$ which in principle may be chosen arbitrarily, and the resulting distribution of amplitudes and phases at the sending slits referred to as 16*a*, 16*b* may be compared with the desired distribution and be optimized iteratively.

For $l_3$, it is suitable to take $\lambda_H/2$ as a starting value, wherein $\lambda_H$ is the wavelength at the working frequency in the transversal hollow waveguide 13. By this selection, constructive interference between a wave propagating towards the short-circuited end and a wave reflected from there is achieved, whereby the excitation of the chamber 15*b* and, hence, the amplitude at its sending slit 16*b*, is maximum.

As a starting value of $l_2$, $$l_2 = \frac{\Delta\varphi}{2\pi}\lambda_H$$

may be selected, wherein $\Delta\phi$ is the known desired phase difference between the sending slits 16*a*, 16*b*. In general, the phase difference actually achieved with this starting value will differ from $\Delta\phi$, since the positions of the coupling slits 14*a*, 14*b* at the bottom of chambers 15*a*, 15*b* are not necessarily equal. In order to increase the actually resulting phase difference, $l_2$ will be increased and vice versa.

As a starting value of $l_1$, one may take $e_1$.

Figure 4:
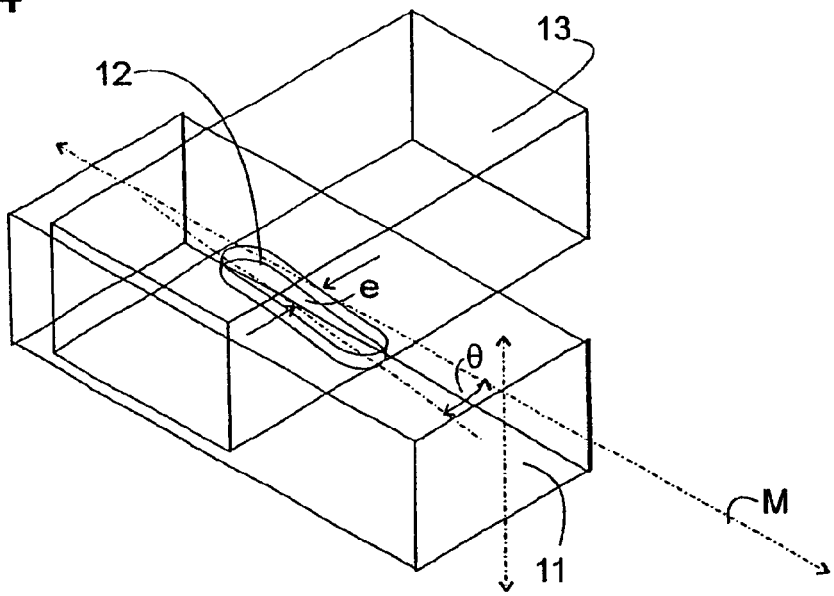
FIG. 4 is a schematic view of the coupling portion between a longitudinal hollow waveguide and a transversal hollow waveguide of the sector antenna.
Figure 5:
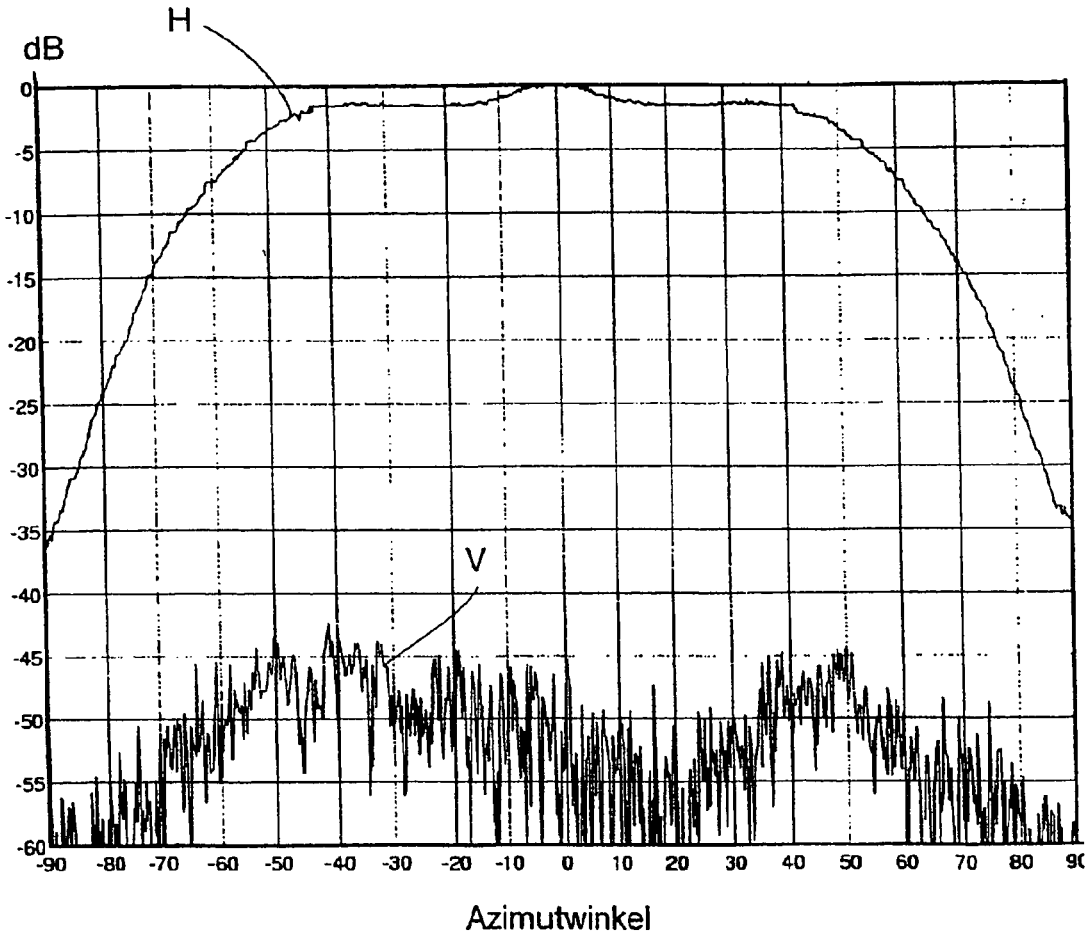
FIG. 5 is an azimuth direction-characteristic of a antenna according to the invention.

A direction characteristic obtained for parameter values $l_1$=0.25 $\lambda_H$, $l_2$=0.30 $\lambda_H$, $l_3$=0.53 $\lambda_H$ is shown in FIG. 4. The curve H shows the amplitude for horizontal polarization normalized to maximum, and curve V is the amplitude for vertical (cross) polarization. For horizontal polarization, a 90° sector direction characteristic with a very small ripple between 0 and ±45° and a steady decrease to less than −35 dB at 90° can be seen. The vertical radiation is nowhere more than −42 dB. A steeper shape of the flanks of curve H might be obtained by increasing the number of chambers 15.

By optimizing, $l_1$, $l_2$, $l_3$ are obtained as multiples of $\lambda_H$. Since the hollow waveguide wavelength $\lambda_H$ depends on the width a of the hollow waveguide according to the formula $$\lambda_H = \frac{\lambda_0}{\sqrt{1-\left(\frac{\lambda_o}{2a}\right)^2}},$$

it may become much longer than the free space wavelength $\lambda_0$ close to the critical frequency. This might cause the coupling slits for the 14*a*, 14*b* to be so far apart from each other along the transversal hollow waveguide 13 that the chambers 15*a*, 15*b* cannot be located so that they connect the coupling slits 14*a*, 14*b* with the sending slits 16*as*, 16*b* located at a distance $\lambda_H/2$. However, this problem may be avoided if the width a of the transversal hollow waveguide 13 is chosen large enough. A width $$a = \frac{\lambda_0}{2\sqrt{1-\frac{\lambda_0^2}{4d^2}}}$$

equal to that of the longitudinal hollow waveguide has shown to be appropriate, it is also compatible with the requirement that the transversal hollow waveguide 13 must not be wider than what corresponds to the distance d between excitation apertures 12.

While for the case of the 90° sector direction characteristic as considered up to now, for sending slits already provide a good result, for realizing a 45° sector, an arrangement of six sending slits is more appropriate, since here a higher flank steepness of the direction characteristic is necessary. The required amplitudes and phases at the sending slits are calculated by simulation, as above; for the individual sending slits, one after the other, what is obtained is:

(−5.7 dB; 123°); (−5.65 dB; 76°), (0; 0); (0; 0); (−5.65 dB; 76°)(−5.7 dB; 123°).

The distances of the coupling slits among each other and between them and the end of the transversal hollow waveguide can be found iteratively by optimization as described above.

Figure 6:
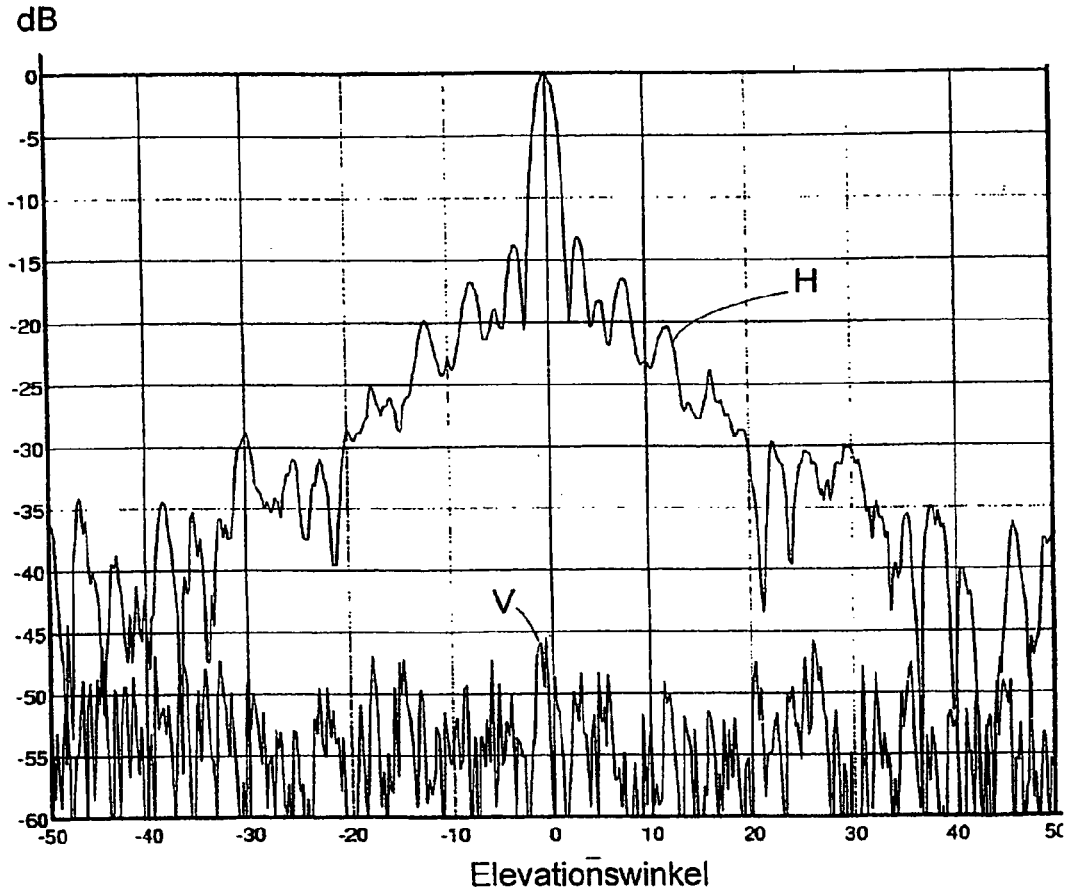
FIG. 6 is a diagram of the elevation direction characteristic of the antenna.

In the vertical plane, a sharply collimated, zero-free radiation characteristic is desired. Here, too, simulation calculations according to known methods enable to calculate optimum amplitudes and phases for this purpose for a plurality of sending slits placed at a vertical distance d from each other. An example of an elevation direction characteristic with curves H, V for horizontal and vertical polarizations, respectively, that can be realized with the group antenna according to the invention is shown in FIG. 6.

Since the dimensions of all transversal hollow waveguides 13 and the positions of the excitation aperture 12 and the coupling openings 14 and the chambers 15 connected thereto and their sending slits 16 is the same at each transversal hollow waveguide 13, the phase difference between excitation at the aperture 12 and radiation from the sending slits 16 is the same. It is therefore sufficient to excite the transversal hollow waveguides 13 with amplitudes and phases corresponding to these optimal relative phases and amplitudes in order to obtain a corresponding phase relationship between sending slits 16 located one above the other of various transversal hollow waveguides 13. These amplitudes and phases may be tuned by appropriate choice of deviation e and rotation angle θ of the slit-shaped excitation apertures 12 with respect to the center plane 11 of the longitudinal hollow waveguide 9 (see FIG. 4).

Figure 7:
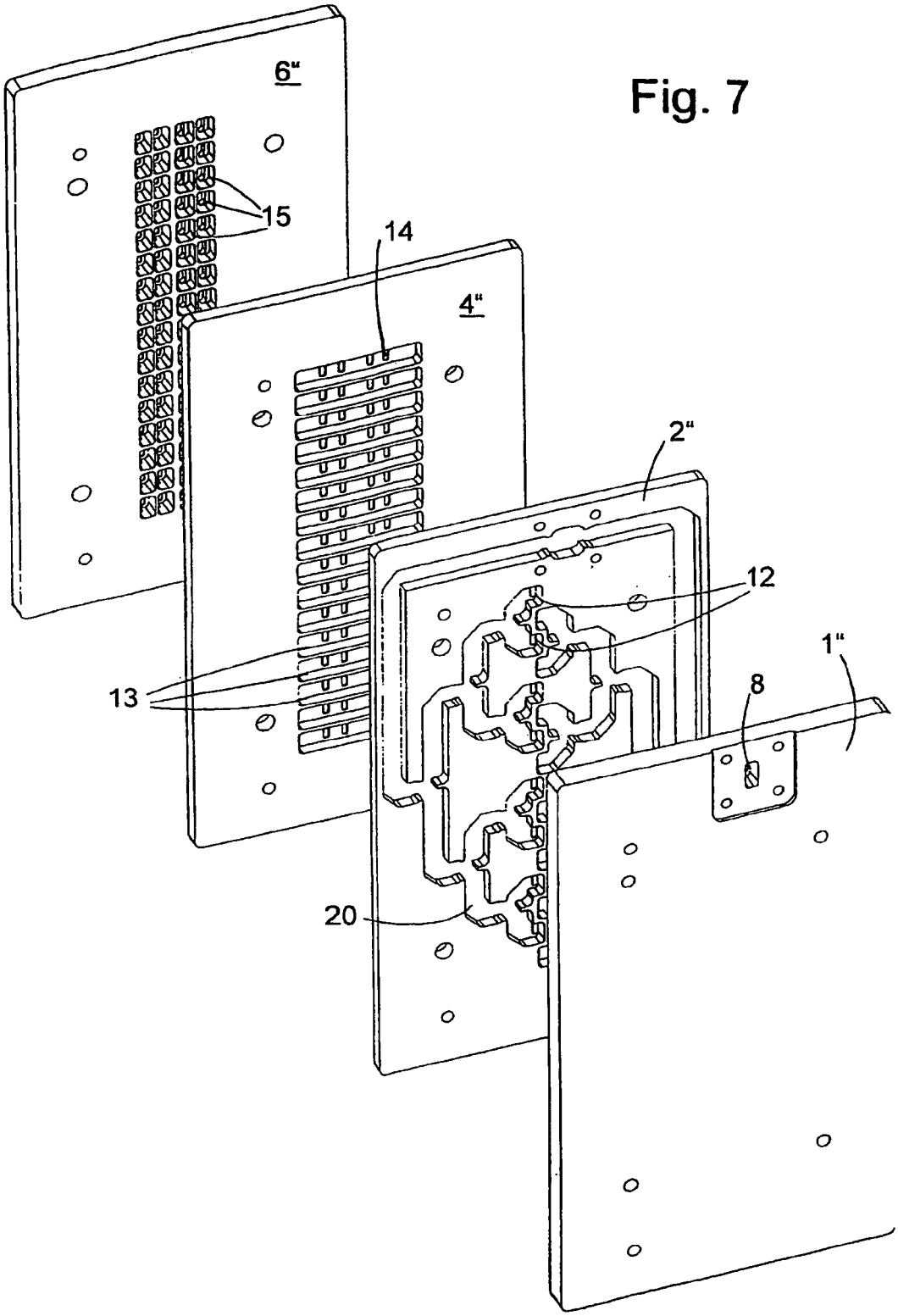
FIG. 7 is an exploded perspective view of a third embodiment of the antenna according to the invention.

A third embodiment of the antenna according to the invention is shown in an exploded view in FIG. 7. This embodiment, like that of FIG. 2, is made up of four plates 1", 2", 4", 6". The plate 1" differs from the plate 1 of FIGS. 1 and 2 merely by the position of the bore 8 which, here, is close to an edge of plate 1".

Figure 8:
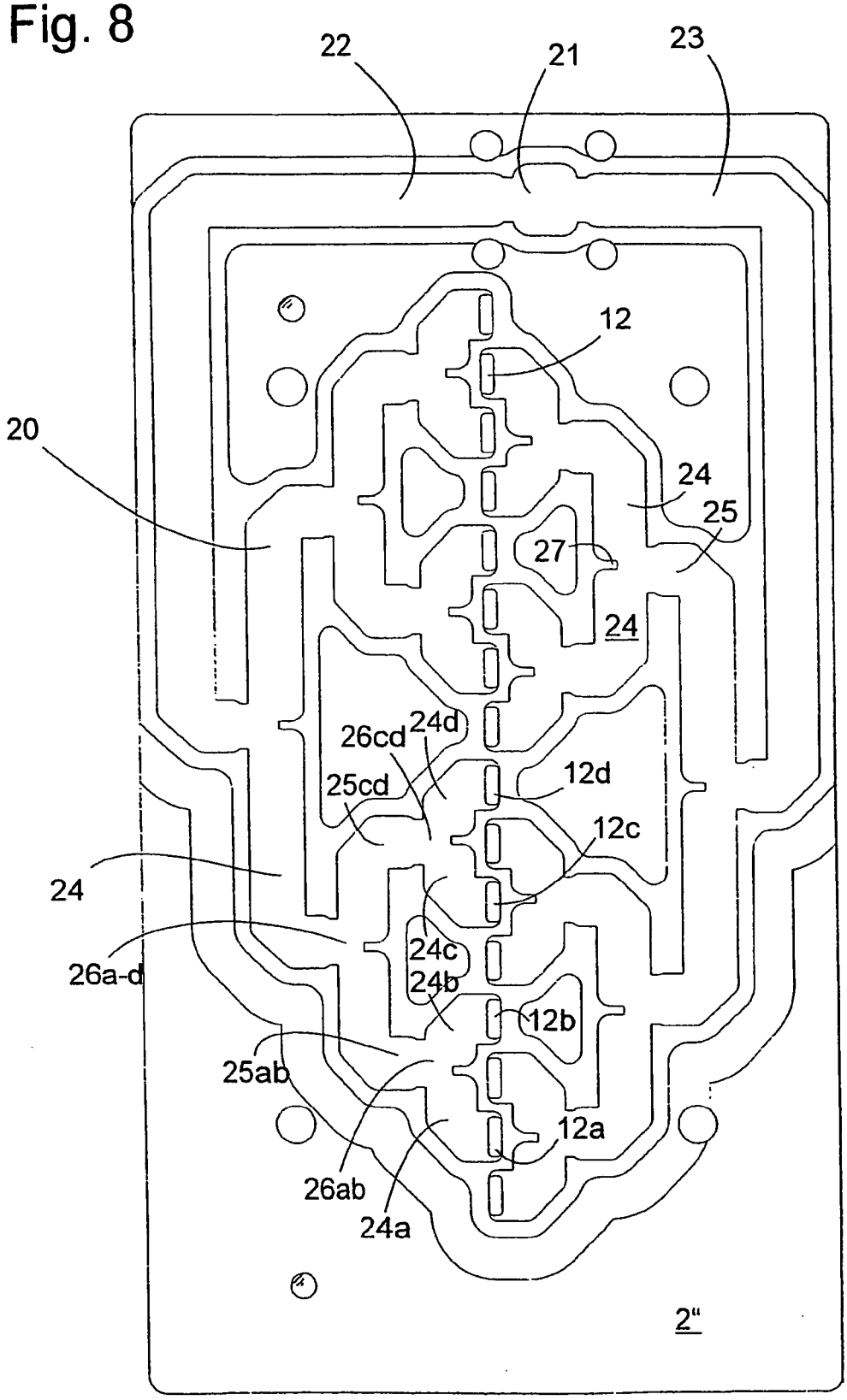
FIG. 8 is a top view of the plane of the first waveguide in the antenna of FIG. 7.

In the plate 2", a tree structure 20 is machined. A trunk 21 of the tree structure 20 is formed by a chamber to which, in an assembled state of the group antenna, the bore 8 leads. From this trunk 21, two main branches 22, 23 extend in opposite directions. These main branches bifurcate repeatedly and finally end at excitation apertures 12, each of which feeds a transversal hollow waveguide 13 in plate 6". The excitation apertures are all congruent and aligned with each other. Mutually adjacent excitation apertures 12 are alternatingly connected to main branches 22 and 23. The main branches 22, 23 bifurcate repeatedly in order to reach the excitation apertures 12. The branches leading to the excitation apertures 12 are formed of portions 24 extending in parallel to the direction of alignment of the excitation apertures 12, portions 25 that extend perpendicular to this direction, and T-shaped bifurcations 26, as can be seen detail in the top view of plate 2" of FIG. 8. With this structure, it is easy to design the tree structure 20 such that due to different path lengths between the trunk 21 and the various excitation apertures 12, desired phase differences between the individual excitation apertures 12 result. Consider e.g. the excitation apertures referred to as 12*a*, 12*b* in FIG. 8, which are supplied by a common T-bifurcation 26*ab*. A desired phase displacement between the two results from an appropriate choice of the length of portions 24*a*, 24*b*, i.e. from the placement of the T-bifurcation 26*ab* in the vertical direction of FIG. 8. In the same way, the phase relationship between the excitation apertures 12*c*, 12*d* can be set by placing the T-bifurcation 26*cd*. The phase difference between the excitation apertures 12*a*, 12*c*, however, results from the position of a T-bifurcation 26*a–d* feeding both together. This method may be repeated cyclically, until finally, by placing the trunk 21 in the horizontal direction of FIG. 8, the phase relationship between the excitation apertures fed by main branch 22 and by main branch 23, respectively, is determined.

A tongue 27 extends into each T-bifurcation 26. This tongue determines the width of the passage between the portion 25 extending horizontally in the Figure and the two vertical portions 24 of each T-bifurcation, and thus, the distribution of the amplitude of an incoming wave onto the two vertical portions 24.

The set of tongues 27 that are passed by a wave in a branch of the tree structure between the trunk 21 and an excitation aperture 12 defines the amplitude at this excitation aperture 12.

The invention claimed is:

1. A hollow waveguide group antenna, comprising: a transversal hollow waveguide extending in a first direction in space; and a plurality of chambers each having a sending/receiving slit and being coupled to the transversal hollow waveguide by a coupling slit, the sending/receiving slits being placed at a fixed distance, the coupling slits being distributed in the first direction in space at the transversal hollow waveguide differently from the sending/receiving slits such that a wave at a working frequency propagating in the transversal hollow waveguide excites the sending/receiving slits with amplitudes and phases suitable for realizing a sector direction characteristic.

2. The group antenna according to claim 1, in that the fixed distance is between 0.5 $\lambda_0$ and 0.65 $\lambda_0$, wherein $\lambda_0$ is a free space wavelength of the wave at the working frequency of the group antenna.

3. The group antenna according to claim 1, in that the coupling slits and the sending/receiving slits are oriented transversally with respect to the first direction in space.

4. The group antenna according to claim 1, in that the transversal hollow waveguide has a short circuit at at least one end thereof.

5. The group antenna according to claim 4, in that the short circuit is spaced at a distance from the next adjacent coupling slit, the distance being approximately half of a hollow waveguide wavelength of the wave at the working frequency.

6. The group antenna according to claim 5, in that the distance of the short circuit from the next adjacent coupling slit is between 0.5 and 0.55 times the hollow waveguide wavelength.

7. The group antenna according to claim 1, in that the coupling slits are arranged mirror symmetric with respect to a symmetry plane extending transversally with respect to the first direction in space, and in that the transversal hollow waveguide has an excitation aperture intersecting the symmetry plane.

8. The group antenna according to claim 7; in that the transversal hollow waveguide has a short circuit at both ends thereof.

9. The group antenna according to claim 1, in that the coupling slits are numbered between four and six.

10. The group antenna according to claim 7, in that the coupling slits number four, and in that two of the coupling slits adjacent to the symmetry plane are located at a distance from the symmetry plane, the distance being one quarter of a hollow waveguide wavelength of a wavelength at the working frequency.

11. The group antenna according to claim 7, in that the coupling slits number four, and in that one of the coupling slits adjacent to the symmetry plane is located at a distance from another coupling slit adjacent to the short circuit, the distance being 0.3 times a hollow waveguide wavelength.

12. The group antenna according to claim 1, and a plurality of plates, the transversal hollow waveguide being formed in at least one of the plates, and the chambers being formed in another of the plates.

13. A two-dimensional group antenna, comprising: an assembly of hollow waveguide group antennas, each including a transversal hollow waveguide extending in a first direction in space, and a plurality of chambers each having a sending/receiving slit and being coupled to the respective transversal hollow waveguide by a coupling slit, the sending/receiving slits being placed at a fixed distance, the coupling slits being distributed in the first direction in space at the respective transversal hollow waveguide differently from the sending/receiving slits such that a wave at a working frequency propagating in the respective transversal hollow waveguide excites the sending/receiving slits with amplitudes and phases suitable for realizing a sector direction characteristic; and the transversal hollow waveguides of the assembly being parallel to each other.

14. The group antenna according to claim 13, in that each transversal hollow waveguide has an excitation aperture leading to a hollow waveguide common to several of the transversal hollow waveguides.

15. The group antenna according to claim 14, in that the common hollow waveguide is a longitudinal hollow waveguide extending linearly in a second direction in space.

16. The group antenna according to claim 15, in that the longitudinal hollow waveguide is a rectangular hollow waveguide, and in that the excitation apertures are arranged in a side wall of the longitudinal hollow waveguide having a width equal to $\lambda_0$ divided by two times the square root of one minus $\lambda_0$ squared divided by four times d squared, wherein $\lambda_0$ is the free space wavelength of the working frequency, and d is the distance between adjacent excitation apertures.

17. The group antenna according to claim 15, in that the excitation apertures are slits, a rotation angle of which defined with respect to the second direction in space and/or a deviation thereof from a center of the longitudinal hollow waveguide being different for mutually adjacent excitation apertures.

18. The group antenna according to claim 17, in that the mutually adjacent excitation apertures have rotation angles and deviations with opposite signs.

19. The group antenna according to claim 15, in that the common hollow waveguide has a tree structure with a trunk and a plurality of branches, each of which connects the trunk to one of the excitation apertures.

20. The group antenna according to claim 19, in that the tree structure has two main branches extending from the trunk at opposite sides of a plane extending through the excitation apertures, the excitation apertures of mutually adjacent transversal hollow waveguides being connected to different ones of these main branches.

21. The group antenna according to claim 20, in that the phases of a wave fed in at the trunk differ by not more than $2\pi$ at the excitation apertures.

22. The group antenna according to claim 17, in that the slit shaped excitation apertures have a mean length of $\lambda_0/2$, wherein $\lambda_0$ is a free space wavelength at the working frequency of the group antenna.

23. The group antenna according to claim 14, and a plurality of plates, wherein the common hollow waveguide is formed in a plate different from a plate for the transversal hollow waveguides and the chambers.

* * * * *